United States Patent [19]

Minhas et al.

[11] 4,173,671

[45] Nov. 6, 1979

[54] FLAME RETARDANT CARPET AND METHOD FOR PREPARING SAME

[75] Inventors: Pritam S. Minhas, Mendham, N.J.; Bernard Sukornick, Williamsville, N.Y.

[73] Assignee: Allied Chemical Corporation, Morris Township, Morris County, N.J.

[21] Appl. No.: 861,778

[22] Filed: Dec. 19, 1977

[51] Int. Cl.[2] ..... B32B 3/02; B32B 33/00

[52] U.S. Cl. ..... 428/85; 106/18.13; 252/8.1; 428/95; 428/96; 428/97; 428/920; 428/921

[58] Field of Search ..... 428/85, 95, 96, 97, 428/920, 921; 252/8.1; 106/15 FP

[56] References Cited

U.S. PATENT DOCUMENTS

| | | | |
|---|---|---|---|
| 3,811,992 | 5/1974 | Handa | 428/921 |
| 3,861,425 | 1/1975 | Clark | 428/921 |
| 4,061,810 | 12/1977 | Minhas | 428/97 |

*Primary Examiner*—Marion E. McCamish

*Attorney, Agent, or Firm*—Alan M. Doernberg; Jay P. Friedenson

[57] ABSTRACT

Combinations of boric acid with certain dispersible or soluble metal salts, oxides and hydroxides, preferably also with certain hydrocarboxylic acids, provide unexpectedly enhanced flame retardancy to carpets, said flame retardancy being durable to usual carpet cleaning procedures. Such combinations may take the form of certain metal borocitrates or borotartrates.

35 Claims, No Drawings

FLAME RETARDANT CARPET AND METHOD FOR PREPARING SAME

BACKGROUND OF THE INVENTION

As discussed in our copending application Ser. No. 727,072 filed Sept. 27, 1976, now U.S. Pat. No. 4,061,810, a number of metal compounds have been reported in the literature as flame retardants for various substrates. These have included antimony oxide, antimony chloride, phosphates and borates of alkali metals and alkaline earth metals, aluminum hydrate, titanium salts, tin salts and double salts such as potassium hexafluorozirconate and potassium hexafluorotitanate. However, when applied to carpets, the flame retardancy provided is not durable to usual cleaning procedures.

Also, as discussed in application Ser. No. 727,072, various patents have issued on compositions reporting flame retardancy; however, investigations have continued to develop improved flame-retardant carpet wherein the flame retardancy is particularly durable. The present invention is concerned with such improved flame-retardant carpets and methods of preparing same.

BRIEF DESCRIPTION OF THE INVENTION

The present invention includes a flame-retardant carpet having a relatively pliable primary backing and a tufted surface, said surface being comprised of fibers selected from the group consisting of polyester and polyamide fibers, said carpet having from about 1 to about 15 weight percent of a composition added thereto, said composition comprising:

(a) about 10 to about 80 weight percent of a polyvalent metal compound selected from the group consisting of the dispersible and soluble salts, oxides and hydroxides of aluminum, antimony and the alkaline earth metals;

(b) about 5 to about 85 weight percent of boric acid; and (c) 0 to about 85 weight percent of a hydroxy carboxylic acid selected from the group consisting of maleic acid, citric acid, tartaric acid, gallic acid and 2,4-dihydroxybenzoic acid. The present invention also includes a process of producing a carpet which comprises adding to the carpet from about 1 to about 15 weight percent of the above composition and curing said composition on the carpet at a temperature of about 100° C. to about 150° C., whereby said carpet has improved flame retardancy and said flame retardancy has improved durability to carpet cleaning procedures.

DETAILED DESCRIPTION OF THE INVENTION

The present invention provides a flame-retardant carpet which retains its aesthetic properties and is surprisingly flame retardant even after repeated cleanings. By "flame retardant carpet" is meant that the carpet burns very slowly when exposed in air to a direct flame or its equivalent. The preferred method of testing for flame-retardant properties is the modified United States Department of Commerce test, DOC FF1-70 described in our application Ser. No. 727,072 and in the present examples. Using this test, a pass and fail face fiber temperature can be determined for a treated carpet sample before any washings and after any given number of washings.

The untreated carpets are well-known materials, as described in our application Ser. No. 727,072 which is incorporated herein by reference for a more detailed description. In general, such carpets have a primary backing, a secondary backing, a latex binder and various polyester or polyamide fibers tufted therethrough. The preferred polyamides include polycaprolactam and condensation products of a dicarboxylic acid with a diamine such as polyhexamethylene adipamide and polyhexamethylene sebacamide or copolymers thereof. The preferred polyesters are the linear terephthalate polyesters, i.e. polyesters of a glycol containing from 2 to 20 carbons and a dicarboxylic acid component containing at least about 75% terephthalic acid. The remainder, if any, of the dicarboxylic acid component may be any suitable dicarboxylic acid such as sebacic acid, adipic acid or isophthalic acid. The glycols may be, for example, ethylene glycol, diethylene glycol, butylene glycol, or decamethylene glycol. Preferred examples are poly(ethylene terephthalate) and poly(butylene terephthalate).

Preferably, the composition comprises at least 5 weight % hydroxy carboxylic acid and more preferably between about 20 and about 85 weight percent of hydroxy carboxylic acid. Preferably, if the hydroxycarboxylic acid is citric acid (or tartaric acid), then boric acid and citric acid (or tartaric acid) are present in substantially equimolar amounts and complexed as borocitric acid (or borotartaric acid) or a salt thereof. Even more preferably, the polyvalent metal compound is also present in substantially equimolar amounts (based on moles of metal cation) and is complexed as the metal borocitrate (or metal borotartrate). Preferred are the antimony and magnesium borocitrates (or borotartrates).

In treating the carpet in accordance with the process of this invention, from about 1 to about 15 weight percent of the treating composition is applied to the carpet, as previously described. The metal complexes formed by the combination of ingredients are all essentially insoluble in water. In practicing the invention, the composition is dispersed or suspended in a solvent, preferably water, to make a pad bath of preferably about 0.5 to about 12 weight percent dispersion in a solvent such as water. The carpet is then soaked by the pad bath, which may also contain other additives commonly used in finishing carpets to improve properties of the carpet or to facilitate finishing. The carpet is then squeezed with any suitable apparatus such as pad rollers to remove excess solution. The squeezing apparatus, such as the rollers, is adjusted to give from about 25 to about 300 weight percent wet pick-up. The carpet is then dried and cured in a dryer or oven, preferably at a temperature of 100° to 150° C. The dispersion may be applied to the carpet in numerous ways. For example, the carpet may be immersed in the dispersion or the dispersion may be sprayed upon the carpet or applied to the carpet by means of pad rollers.

In accordance with another preferred procedure, after padding, the wet carpet is exposed to steam at atmospheric pressure for several minutes, rinsed with water and dried at 100° to 150° C. The steamed carpet is superior to unsteamed carpet in appearance and softness of hand.

Preferred forms of the treated carpet and method include those wherein the treating composition is as follows. It is preferred that the composition contain between about 20 and about 50 weight percent of the polyvalent metal compound, between about 20 and about 60 weight percent boric acid and between about 20 and about 60 percent of the hydroxy carboxylic acid. Preferred polyvalent metal compounds include aluminum hydroxide, antimony oxide, barium hydroxide and magnesium hydroxide. Preferred hydroxycarboxylic acids include gallic, tartaric and citric acids. With citric acid it is most preferred that the boric and citric acids be provided in substantially equimolar amounts. With tartaric acid, it is most preferred that the boric and tartaric acids be applied in substantially equimolar amounts. By substantially equimolar is meant those ratios that will cause most of each acid to be in the complex acids borocitric acid, borotartaric acid or their salts. It is also most preferred that the polyvalent metal compound be provided in a proportion where most of it will be in a complex salt such as a borocitrate or borotartrate.

The polyvalent metal can be provided in any form that will permit formation of complexes with the boric acid and hydroxycarboxylic acid, if the latter is included. For most of the above metals, soluble salts, hydroxides or oxides may be used such as the more soluble of the hydroxides, oxides, chlorides, fluorides, nitrate, sulfates and the like. In general, it is preferred to use the more soluble of the above forms, such as the barium chloride rather than the barium sulfate. Nevertheless, insoluble hydroxides, oxides and salts may be used under conditions (such as with a surfactant) that will suspend the metal compound, such as antimony oxide, finely enough to permit complexing with the boric acid (and organic acid if present) to form a highly insoluble material which may be deposited on the fibers.

The above discussion is phrased primarily in terms of water as the prefered solvent or dispersant, but the same rules would apply to other solvents or dispersants. When water is used, surfactants of conventional types may be used to promote solubility or dispersion.

In many preferred forms "substantially equimolar" amounts of boric acid, hydroxycarboxlic acid and polyvalent metal complex are used. By this is meant that about one mole of boric acid is provided for each mole of hydroxycarboxlic acid so as to form the complex acids borocitric acid, borotartaric acid and the like. Similarly a substantially equimolar or stoichiometric amount of the polyvalent metal oxide, hydroxide or salt is used to form the corresponding borocitrate, borotartrate or the like, with the complex acid apparently only linked to one of the metal valences. Small excess amounts of certain ingredients may promote formation of the insoluble complex acid or salt and thus are within the range of "substantially equimolar" amounts. Excesses of any component that do not promote complex acid or salt formation are less preferred.

EXAMPLE 1

Four-inch by four-inch carpet test specimens having polycaprolactam fibers in a jute primary backing were treated with 3.0% by weight of fibers boric acid and 6.5% by weight of fibers of antimony oxide suspended in a pad bath of distilled water. The specimens were then squeezed through a padder and dried in an oven at 125° C. They were then given a secondary backing with a latex binder having no flame retardant.

For testing by the "Aggravated Pill Test" described in our application Ser. No. 723,072, several samples were placed in a draft free box made of one-inch thick cement asbestos board. A 3½ inch inner diameter iron ring was placed over the carpet to hold it down and to prevent buckling or other distortion during the test. A methenamine pill was placed in the center of the test specimen and three thermocouples placed gently resting in the pile to give representative values, continuously and automatically, of the face fiber temperature. The carpets were heated by infrared heat modules to the desired temperature after about five minutes of heating. Then the heat modules were turned off and the methenamine pill lit with a match. After the test sample had stopped burning, the maximum average burn diameter and time of burning were noted. Any sample having a maximum burn diameter of 5 centimeters or larger or a burn time of 3 minutes or longer was scored a failure. Multiple samples of similarly treated carpet were heated to various temperatures before lighting the pill and the lowest fail and highest pass temperature noted. Before any washings, these first samples passed at 202° C.

Similar samples were laundered following procedure 124–1973 in the Technical Manual of the American Association of Textile Chemists and Colorists. The laundered test pieces, after drying, were conditioned at ambient conditions for 48 hours before testing by the "Aggravated Pill Test". After one such washing and then conditioning, the samples failed at 201° C., but passed at 195° C. After three such washings, and then conditioning, the samples failed at 198° C. After 5 such washings and then conditioning, they passed at 190° C. These results are summarized in Table 1.

COMPARATIVE EXAMPLES 2, 3 AND 4

Example 1 was repeated separately with carpets treated with 10% of weight of fibers of boric acid, 10.2% of weight of fibers of citric acid and 10% of weight of fibers antimony oxide. The results are summarized in Table 1. As shown in Table 1, none of the three components alone gave the flame retardant properties and durability of flame retardance of the combinations in Example 1 and in Examples 6–10, discussed below.

COMPARATIVE EXAMPLE 5

Padding baths were prepared with borocitric acid, a complex acid, by method described in S. Prasad and N. P. Singh, *J. Indian Chemical Society,* Vol. 44 (3), page 219 (1967). Briefly, the process consisted of adding 19.2 gms of citric acid and 6.2 gms of boric acid in 400 gms of distilled water for complete solution. This provided borocitric acid which was highly water soluble and could not be readily isolated. It was, however, not necessary to do so when treatment of the carpet samples with borocitric acid was desired, since a dispersion could be prepared without isolation. The results of treatment with this bath are displayed in Table 1.

EXAMPLES 6 AND 7

Highly water insoluble polyvalent metal salts were prepared by first completely neutralizing the above borocitric acid with sodium hydroxide and then converting the water soluble sodium borocitrate into the desired insoluble compound. For example, the above borocitric acid was neutralized with 12.0 grams of sodium hydroxide and the reaction mixture was stirred for about 30 minutes and a non-ionic surface active agent (Mykon NRW-3 from Sun Chemical Corp.) was added to provide 0.5% on the weight of the total solution. Now, with vigorous and continuous stirring, a stoichiometric amount of antimony chloride was added, small quantities at a time. Continuous and vigorous stirring and the presence of surface active agent produced a very fine dispersion of the insoluble antimony borocitrate. Such a fine dispersion is highly desirable in preparing these flame retardant pad baths. This composition is then applied to the test specimens as in Example 1 at levels of 5.0% and 9.2% by weight of fibers and subjected to the Aggravated Pill Test described in Example 1. The results of these Examples 6 (at 5%) and 7 (at 9.2%) are displayed in Table I.

EXAMPLES 8-10

Example 6 is repeated for the magnesium, aluminum and barium borocitrates prepared by substituting magnesium chloride, aluminum chloride and barium chloride for the antimony trichloride in Examples 6 and 7, but applied at levels of 9.0%, and 10.0% and 10.0%, respectively. The results of the "Aggravated Pill Test" are displayed in Table 1. These complex salts all gave good flame retardance and durability, but not as good as the antimony borocitrate.

CONTROL

Example 1 was repeated using no flame retardant composition. The results are displayed in Table 1 as a base for showing the flame retardancy of the compositions and components.

Table 1

| Ex. | Material Applied | Level % OWF | Aggravated Pill Test Flame Retardance (After No. of Launderings) 0 | 1 | 3 | 5 | 10 |
|---|---|---|---|---|---|---|---|
| 1 | Boric Acid | 3.0 | | | | | |
| | Antimony Oxide | 6.5 | 202/— | 195/201 | 191/198 | 190/— | 190/197 |
| 2 | Boric Acid | 10.0 | 147/163 | —/146 | —/146 | —/147 | —/— |
| 3 | Citric Acid | 10.2 | 207/— | 191/200 | 178/184 | —/152 | —/152 |
| 4 | Antimony Oxide | 10.0 | 174/184 | —/— | —/161 | —/— | —/— |
| 5 | Borocitric Acid | 10.0 | 203/— | 184/192 | 178/185 | 179/185 | 153/165 |
| 6 | AnBC | 5.0 | 195/204 | 183/191 | 181/193 | 180/— | 171/180 |
| 7 | AnBC | 9.2 | 205/— | 200/N.T. | 200/N.T. | 199/— | 201/211 |
| 8 | MgBC | 9.0 | 173/180 | N.T. | 172/180 | 159/169 | 158/170 |
| 9 | AlBC | 10.0 | 181/192 | —/— | 137/148 | 138/148 | 140/149 |
| 10 | BaBC | 10.0 | 144/152 | 147/153 | —/— | —/— | —/157 |
| - | Control | 0.0 | 141/151 | 131/139 | 127$^m$/139 | 115/123 | —/— |

AnBC = Antimony Borocitrate; MgBC = Magnesium Borocitrate; AlBC = Aluminum Borocitrate; BaBC = Barium Borocitrate; = not tested; m = marginally passed.

We claim:

1. A flame-retardant carpet having a relatively pliable primary backing and a tufted surface, said surface being comprised of fibers selected from the group consisting of polyester and polyamide fibers, said carpet having from about 1 to about 15 weight percent of a composition added thereto, said composition comprising:
   (a) about 10 to about 80 weight percent of a polyvalent metal compound selected from the group consisting of the dispersible and soluble salts, oxides and hydroxides of aluminum, antimony and the alkaline earth metals;
   (b) about 5 to about 85 weight percent of boric acid; and
   (c) 0 to about 85 weight percent of a hydroxy carboxylic acid selected from the group consisting of maleic acid, citric acid, tartaric acid, gallic acid and 2,4-dihydroxybenzoic acid.

2. The flame retardant carpet of claim 1 wherein said composition comprises at least about 5 weight percent of said hydroxy carboxylic acid.

3. The flame retardant carpet of claim 2 wherein said polyvalent metal compound is antimony oxide.

4. The flame retardant carpet of claim 2 wherein said composition comprises about 30 to about 70 weight percent antimony oxide and about 30 to about 70 weight percent boric acid.

5. The flame retardant carpet of claim 2 where said composition includes about 20 to about 85 weight percent of said hydroxycarboxylic acid.

6. The flame retardant carpet of claim 2 where said hydroxycarboxylic acid is gallic acid.

7. The flame retardant carpet of claim 2 where said hydroxycarboxylic acid is maleic acid.

8. The flame retardant carpet of claim 2 where said hydroxycarboxylic acid is citric acid.

9. The flame retardant carpet of claim 8 where said boric and citric acids are present in substantially equimolar amounts and complexed as borocitric acid or a salt thereof.

10. The flame retardant carpet of claim 9 where said polyvalent metal compound is present in substantially equimolar amounts and complexed as a polyvalent metal borocitrate.

11. The flame retardant carpet of claim 10 where said polyvalent metal borocitrate is antimony borocitrate.

12. The flame retardant carpet of claim 10 where said polyvalent metal borocitrate is magnesium borocitrate.

13. The flame retardant carpet of claim 2 where said hydroxycarboxylic acid is tartaric acid.

14. The flame retardant carpet of claim 13 where said boric and tartaric acids are present in substantially equimolar amounts and complexed as borotartaric acid or a salt thereof.

15. The flame retardant carpet of claim 14 where said polyvalent metal compound is present in substantially equimolar amounts and complexed as a polyvalent metal borotartrate.

16. The flame retardant carpet of claim 1 where said fibers are polyamides.

17. The flame retardant carpet of claim 16 where said fibers are polycaprolactam.

18. The flame retardant carpet of claim 1 where said fibers are polyesters.

19. A method of producing a carpet which comprises adding to the carpet from about 1 to about 15 weight percent of a composition comprising:

(a) about 10 to about 80 weight percent of a polyvalent metal compound selected from the group consisting of the dispersible and soluble salts, oxides and hydroxides of aluminum, antimony and the alkaline earth metals;

(b) about 5 to about 85 weight percent of boric acid; and (c) 0 to about 85 weight percent of a hydroxy carboxylic acid selected from the group consisting of maleic acid, citric acid, tartaric acid, gallic acid and 2,4-dihydroxybenzoic acid; and curing the carpet at a temperature of about 100° C. to about 150° C., whereby said carpet has improved flame retardancy and said flame retardancy has improved durability to carpet cleaning processes.

20. The method of claim 19 wherein said composition comprises at least 5 weight percent of said hydroxy carboxylic acid.

21. The method of claim 20 wherein said polyvalent metal compound is antimony oxide.

22. The method of claim 20 wherein said composition comprises about 30 to about 70 weight percent antimony oxide and about 30 to about 70 weight percent boric acid.

23. The method of claim 20 where said hydroxycarboxylic acid is gallic acid.

24. The method of claim 20 where said hydroxycarboxylic acid is maleic acid.

25. The method of claim 20 where said hydroxycarboxylic acid is citric acid.

26. The method of claim 25 where said boric acid and citric acid are present in substantially equimolar amounts and complexed as borocitric acid.

27. The method of claim 26 where said polyvalent metal compound is present in substantially equimolar amounts and complexed as a polyvalent metal borocitrate.

28. The method of claim 27 where said polyvalent metal borocitrate is antimony borocitrate.

29. The method of claim 20 where said hydroxycarboxylic acid is tartaric acid.

30. The method of claim 29 where said boric acid and tartaric acid are present in substantially equimolar amounts and complexed as borotartaric acid.

31. The method of claim 30 where said polyvalent metal compound is present in substantially equimolar amounts and complexed as a polyvalent metal borotartrate.

32. The method of claim 19 wherein said composition includes about 20 to about 85 weight percent of said hydroxycarboxylic acid.

33. The method of claim 19 where said carpet includes tufted polyamide fibers.

34. The process of claim 33 where said fibers are polycapralactam.

35. The process of claim 19 where said carpet inclues tufted polyester fibers.

* * * * *